United States Patent [19]

Turcotte

[11] Patent Number: 5,074,278

[45] Date of Patent: Dec. 24, 1991

[54] POCKET VENTILATOR

[75] Inventor: Remi Turcotte, Lery, Canada

[73] Assignee: Enerquin Air, Inc., Montreal, Canada

[21] Appl. No.: 538,227

[22] Filed: Jun. 14, 1990

[30] Foreign Application Priority Data

Sep. 29, 1989 [CA] Canada ..... 614604

[51] Int. Cl.[5] ..... F26B 3/00

[52] U.S. Cl. ..... 34/23; 34/111; 34/114; 34/116

[58] Field of Search ..... 34/111, 114, 116, 23, 34/117, 120, 41, 123, 22

[56] References Cited

U.S. PATENT DOCUMENTS

| | | | |
|---|---|---|---|
| 3,110,575 | 11/1963 | Justus | 34/111 |
| 3,384,973 | 5/1968 | Johansson | 34/111 |
| 3,388,479 | 6/1968 | Gardner | 34/116 |
| 4,505,052 | 3/1985 | Osswald et al. | 34/114 |
| 4,602,439 | 7/1986 | Eskelinen et al. | 34/116 |

*Primary Examiner*—James C. Yeung

*Attorney, Agent, or Firm*—Ratner & Prestia

[57] ABSTRACT

A pocket ventilation system for the dryer section of a paper machine. The ventilation system comprises a plenum with a plurality of orifices producing medium velocity air jets injecting air in the pocket through the dryer fabric, and an orifice producing a high velocity air jet creating a negative pressure zone extracting moisture laden air from the pocket.

19 Claims, 5 Drawing Sheets

POCKET VENTILATOR

FIELD OF THE INVENTION

The invention relates to the art of papermaking and, more particularly, to a ventilation system for use in a dryer section of a paper machine.

BACKGROUND OF THE INVENTION

A conventional dryer in a paper mill comprises two rows of heated drying cylinders about which the wet web is trained forming a series of adjacent pockets. To optimize the heat transfer from the dryer cylinders to the web, the so-called "dryer fabrics" are provided which press the web in intimate contact with the dryer cylinders. Typically, one dryer fabric is provided for each row of drying cylinders, passing from one cylinder to another of the row through a guide roller. This arrangement is such that the web runs exposed in its travel from a tangency with the cylinder of one row to a tangency with a cylinder of the other row. While in contact with a drying cylinder, the web is pressed against that cylinder by a dryer fabric.

In order to evacuate the moisture ladden air which accumulates in the adjacent pockets during the operation of the dryer, it is known to utilize a ventilation system which injects a dehydrating gas in each pocket, such as hot air, evacuated through the open ends of the pocket. This system has been proven unsatisfactory because the amount of injected air in the pocket over pressurizes the pocket. This air must be evacuated through the open end of the pocket; the air exiting the pocket generates turbulence and causes web flutter. Web flutter then causes web break and costly loss of production.

OBJECT AND STATEMENT OF THE INVENTION

An object of the invention is a ventilation system capable to achieve good pocket ventilation, without affecting web stability comparatively to conventional ventilation devices creating web fluttering problems.

In accordance with the invention, there is provided a ventilation system comprising means to establish a positive pressure zone adjacent a section of the dryer fabric between a dryer cylinder and the associated guide roller to pump air in the pocket located immediately below the guide roller, and an air jet oriented away from the pocket to create a negative pressure zone adjacent the section of the dryer fabric extending between the guide roller and the other drying cylinder so that the moisture laden air may be extracted from the pocket through the dryer fabric.

In a preferred embodiment, the ventilation system comprises an air plenum located in the space defined by two adjacent dryer cylinders and the associated guide roller, the plenum extending the entire length of the drying cylinders. A plurality of orifices are provided to create a plurality of medium velocity jets which establish the high pressure zone. These orifices are in the form of slits extending the entire length of the air plenum. A single orifice, on the opposite side of the air plenum, produces the air jet creating the negative pressure zone. Advantageously, a seal is provided between the air plenum and the guide roller to prevent air from passing therebetween as a result of the pressure differential created on either side of the guide roller.

In summary, the invention may be defined as a ventilation device for use in an apparatus for drying a web of the type comprising:

an upper row of rotatable drying cylinders;

a lower row of rotatable drying cylinders, the web being trained through the rows and forming at least one pocket;

a porous dryer fabric urging the web against the drying cylinders of the upper row while the web is trained thereover;

a guide roller mounted between two successive drying cylinders of the upper row, referred as first and second drying cylinders, the guide roller guiding the porous dryer fabric away from the first drying cylinder and toward the second drying cylinder, the ventilation system comprising:

a) means for establishing a positive pressure zone of air between the first drying cylinder and the guide roller outside the pocket, causing air to penetrate in the pocket through the porous dryer fabric; and b) means for producing an air jet between the guide roller and the second dryer cylinder, outside the pocket and directed away from the pocket, causing a negative pressure zone extracting moisture ladden air from the pocket through the drying fabric.

BRIEF DESCRIPTION OF THE DRAWINGS

Throughout the drawings, analogous elements are identified by the same reference numerals.

DESCRIPTION OF A PREFERRED EMBODIMENT

Figure 2:
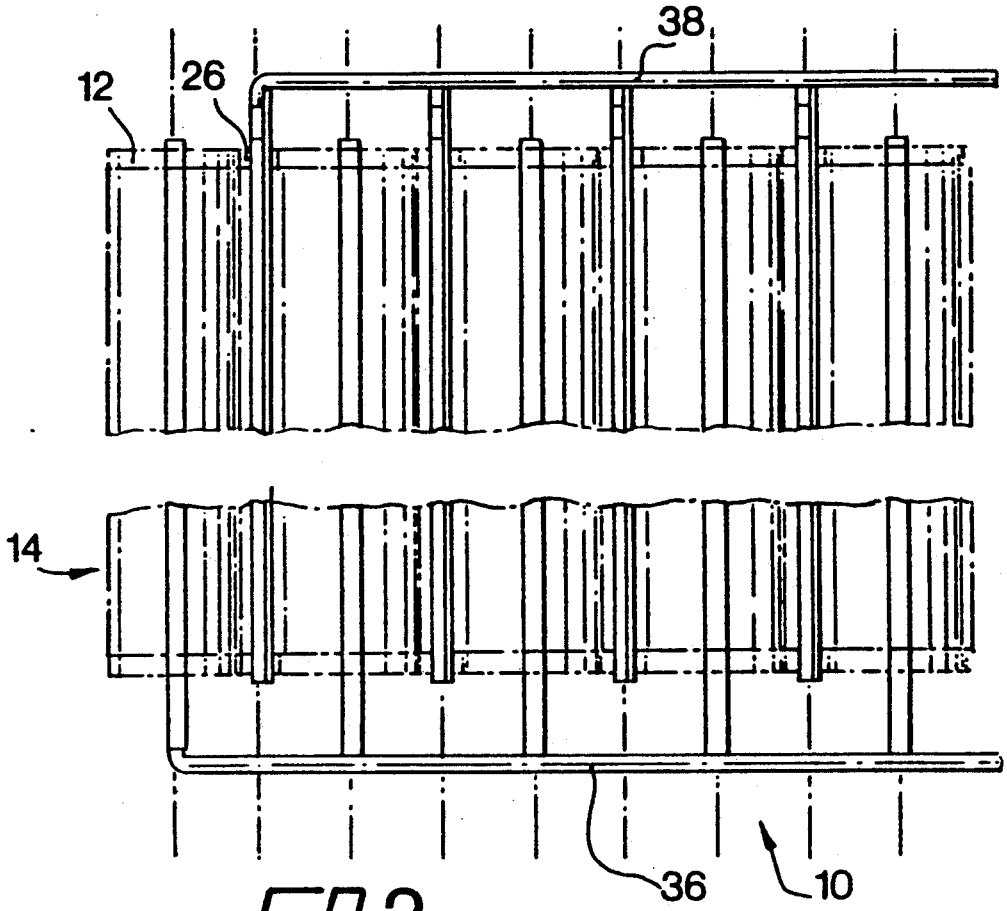
FIG. 2 is a top view of the dryer illustrated in FIG. 1.
Figure 1:
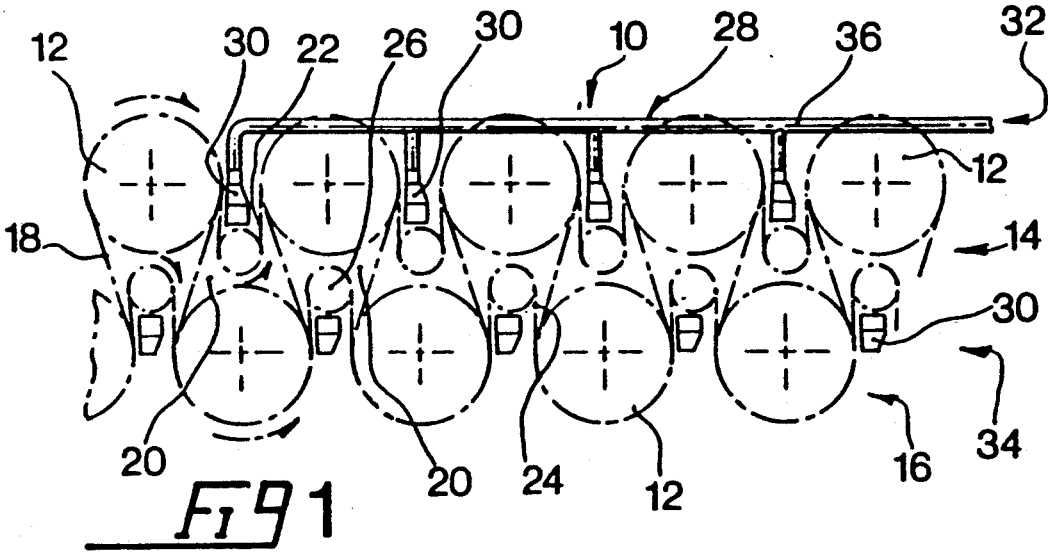
FIG. 1 is a schematical view of a web dryer utilising the ventilation system according to the invention.

The web dryer 10 depicted in FIG. 1 comprises a plurality of heated drying cylinders 12 arranged in two vertically spaced apart rows, namely an upper row 14 and a lower row 16. A web 18 to be dried is trained over the cylinders 12 in a serpentine path defining a series of pockets 20.

Two dryer fabrics 22 and 24, associated with the cylinder rows 14 and 16 respectively, are provided to press the web 18 against the cylinders 12 for a better heat transfer therebetween and consequently to increase the efficiency of the dryer 10. The upper dryer fabric 18 is in wrapping engagement with each cylinder 12 of the upper row 14, and it is guided between adjacent cylinders by guide rollers 26. The structure of the lower fabric 24 is the same as with the upper fabric 22.

The direction of rotation of the various components of the dryer 10 is illustrated by means of arrows in the left hand side of FIG. 1.

It will be appreciated that during the operation of the dryer 10, during the travel of a section of the web 18 from one cylinder 12 in the upper row to the next cylinder 12 in the lower row 16 and vice versa, moisture is released in the pockets 20. This moisture must be evacuated in order to enable the dryer 10 to function properly.

The invention provides an improved ventilation system designated by the reference numeral 28 comprising an air plenum 30 associated with each pocket 20. This arrangement creates an upper row 32 of plenums and a bottom row 34 of plenums, the plenums of the same row being connected to a common air supply duct connected to a suitable blower (not shown). The air supply ducts are identified by the numerals 36 and 38 respectively. In FIG. 1, the air supply duct 38 is omitted to clarify the illustration.

The structure of a plenum 30 will now be described in detailed with reference to FIGS. 3 to 10. The air plenum 30 is an elongated and hollow sheet metal structure located in the space between two adjacent dryer cylinders 12 and a guide roller 26 and extends the entire length of the cylinders 12 and of the roller 26, in other words having a length corresponding to the width of the paper machine. The plenum 30 comprises an upper inlet chamber 39 which communicates with the air duct 36 by means of a coupling 40. An outlet chamber 42 separated from the inlet chamber 38 by means of a perforated plate 44 is provided with orifices 46, 48 and 50 to inject outside the air pumped in the plenum 30.

The orifices 46 and 48 facing the section of the dryer fabric 22 which runs from the dryer cylinder 12 toward the roller 26, are parallel and are located at the level where the dryer fabric separates from the cylinder 12. Each of the orifices 46 and 48 is defined between two lips 52 and 54 extending the entire length of the plenum 30 and are retained to each other by rivets 56. The spacing between the lips 52 and 54 is controlled by washers 58 having a predetermined thickness and being mounted to the rivets 56. The inner extremities of the lips 52 and 54 are flared at 60 to smoothly accelerate the air flow as it passes through the orifices. The outer extremities of the lips 52 and 54 are mounted.

The orifice 50 is provided between an extremity of the sheet used to form the lower outlet chamber 42 retained to the upper chamber 39 by means of rivets 66. The dimension of the orifice 50 are determined by means of washers 68 mounted on the rivets 66. As in the case with the orifices 46 and 48, the orifice 50 extends the entire length of the plenum 30.

Figure 3:
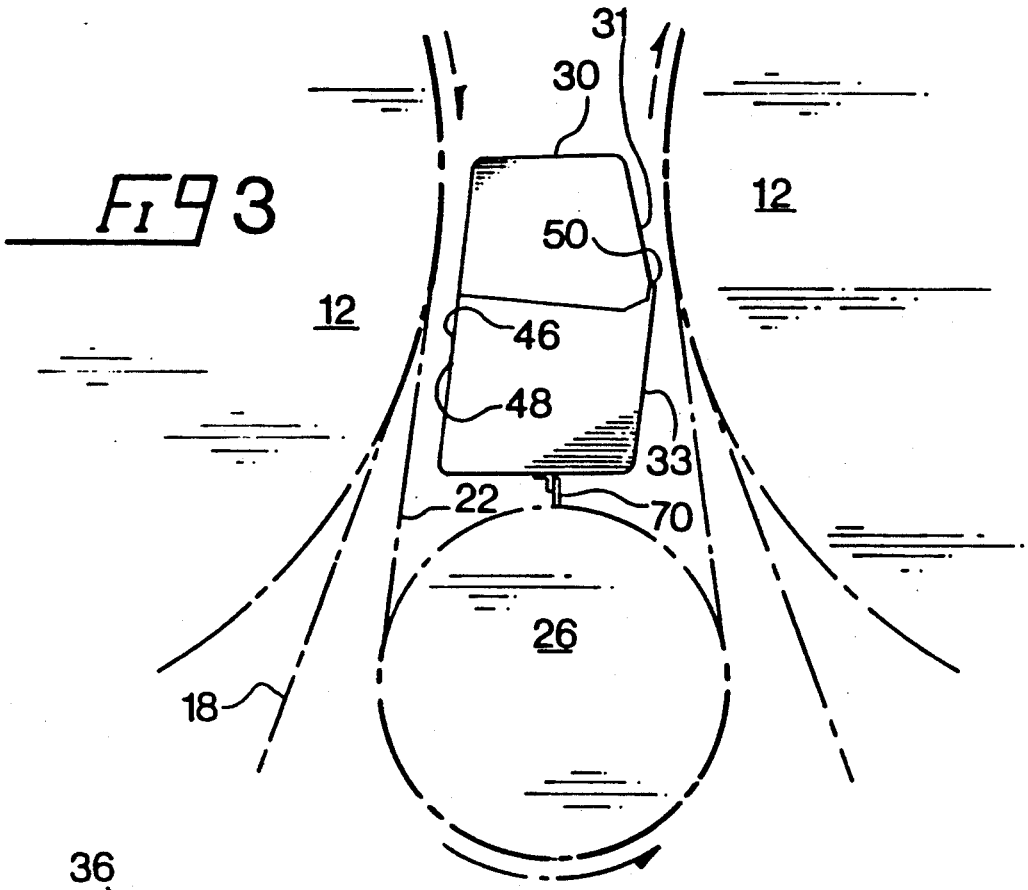
FIG. 3 is an enlarged side view illustrating the air plenum of the ventilation system according to the invention and its relative position with respect to the dryer cylinders and the guide roller of the dryer depicted in FIG. 1.
Figure 4:
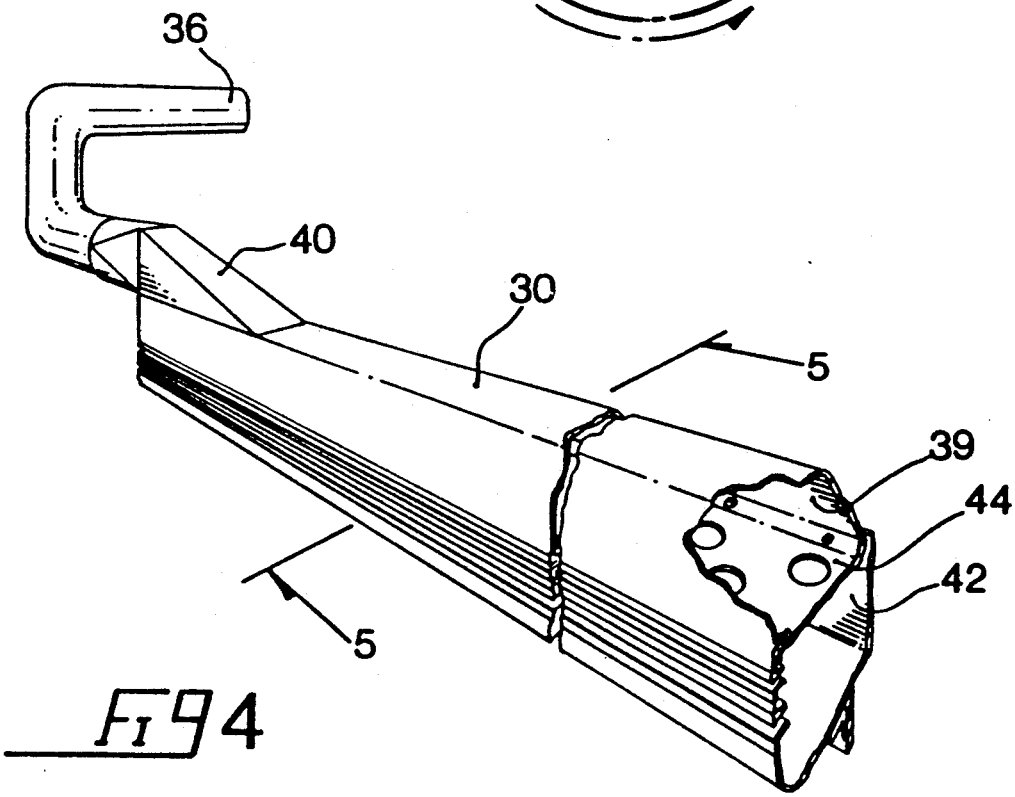
FIG. 4 is a perspective view partly sectional of the air plenum.
Figure 5:
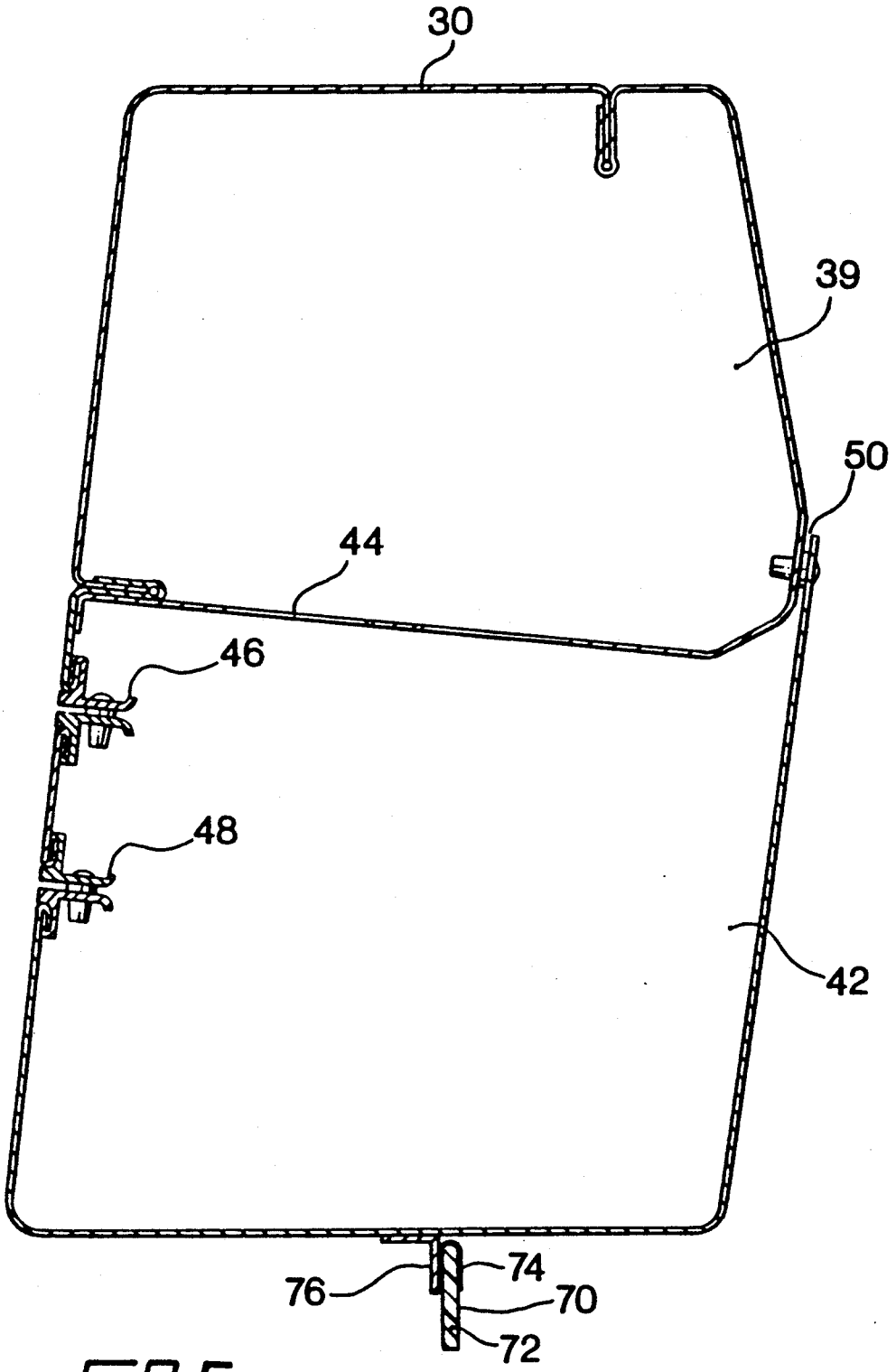
FIG. 5 is a cross-sectional view taken along lines 5—5 in FIG. 4.
Figure 8:
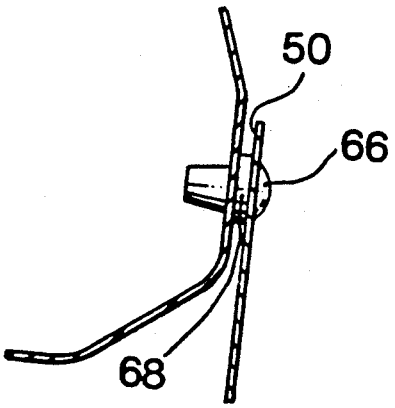
FIG. 8 is a sectional view taken along lines 8—8 in FIG. 7.
Figure 7:
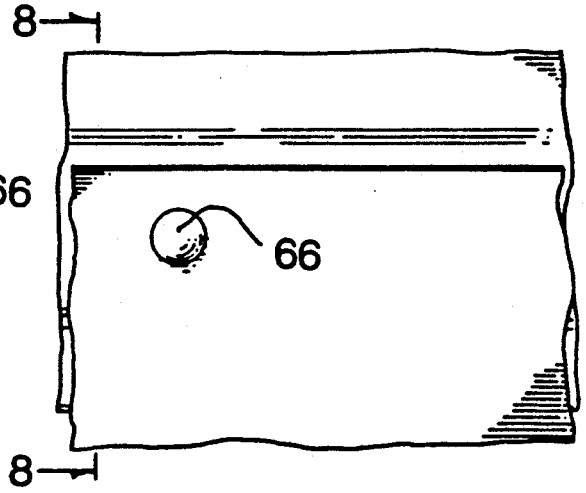
FIG. 7 is a partial elevational view of the air plenum illustrating an orifice to produce an air jet creating a negative pressure.

As best illustrated in FIG. 3, it will be appreciated that the side wall of the plenum carrying the orifice 50 defines two oblique surfaces 31 and 33 forming an apex which coincides with the location of the orifice 50. This structure permits to improve the flow characteristics of the passage formed between the surfaces 31 and 33, and the adjacent cylinder 12.

A seal member 70 is provided between the plenum 30 and the guide roller 26. More particularly, the seal 70 comprises a strip of fabric material 72 received into an inverted U-shaped bracket 74 welded or otherwise attached to an angle bracket 76 which is mounted to the bottom wall of the air plenum 30.

Figure 6:
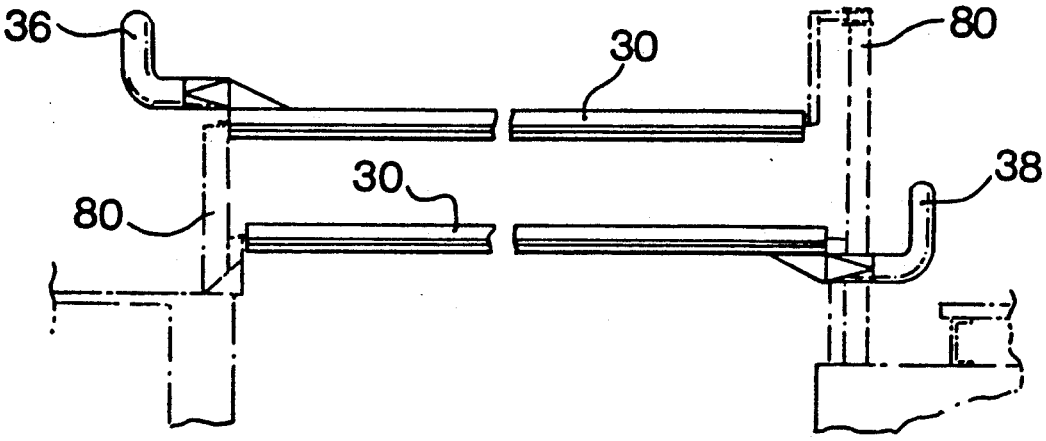
FIG. 6 is a schematical view illustrating the arrangement of two air plenums to ventilate adjacent pockets in the dryer.
Figure 9:
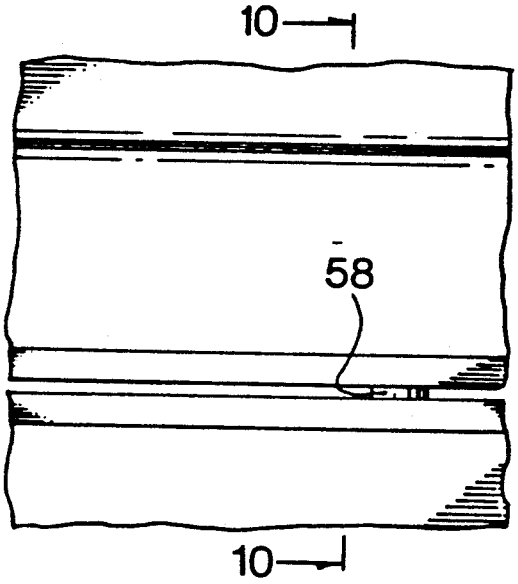
FIG. 9 is a partial elevational view of an air plenum illustrating an orifice to create a positive air pressure.
Figure 10:
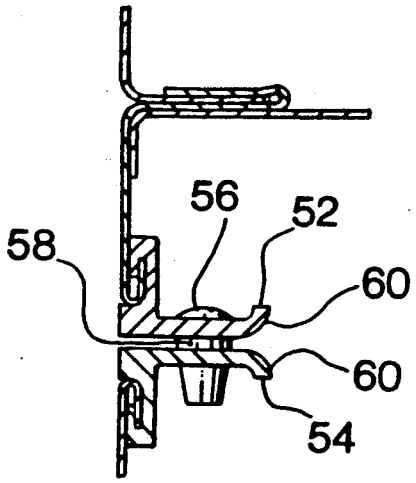
FIG. 10 is a cross-sectional view taken along lines 10—10 in FIG. 9.

The air plenums 30 are held in their respective positions by means of an adequate supporting structure 80, illustrated in dashed lines in FIG. 6. The supporting structure 80 may be constituted by supporting beams or any other members which provide the required rigidity and strength characteristics.

The operation of the ventilating system 28 is as follows. The air pumped through inlet ducts 36 and 38 enters the inlet chamber 39 of the respective plenums 30 where it is channeled in the outlet chamber 42 through the perforated plate 44. The latter is used in order to diffuse and smooth out the air flow. The air mass leaving through the orifices 46 and 48 will create medium velocity jets establishing a positive pressure zone immediately downstream of the point where the dryer fabric 22 separates from the cylinder 12. This positive pressure zone will pump air in the pocket 20 increasing the pressure therein. A plurality of medium velocity jets are preferred over an arrangement using a single high velocity jet because it has been found that in the latter case, a substantial quantity of the air simply bounces off the dryer fabric and does not penetrate in the pocket. When a less turbulent pressure zone is created by means of medium velocity jets, the air quantity pumped in the pocket is substantially augmented.

The orifice 50, producing an air jet generally vertically directed away from the pocket 20 will create a negative pressure zone on the side of the dryer felt which extends from the guide roller 26 toward the second dryer cylinder 12. This negative pressure zone is enhanced by the structure of the plenum side wall creating a gradual restriction culminating where the air jet is generated followed by an enlargement. The negative pressure zone will have the effect of extracting through the dryer felt 22 moisture laden air from the pocket in order to minimize the quantity of moisture laden air exiting the pocket through the open ends, thus reducing the possibility of turbulance and web flutter.

The seal 70 is used to prevent direct passage of air below the plenum 30 from the high pressure zone to the negative pressure zone.

Although a preferred embodiment of the invention has been described above, it should be understood that this description should not be interpreted in any limiting manner since many variations and refinements are possible without departing from the spirit of the invention. The scope of the invention will be defined in the annexed claims.

The embodiments of the invention in which an exclusive property or privilege is claimed are defined as follows:

1. A ventilation system for use with an apparatus for drying a web comprising:

an upper row of rotatable drying cylinders;

a lower row of rotatable drying cylinders, said web being trained through said rows forming a pocket;

a porous dryer fabric urging said web against the drying cylinders of said upper row while said web is trained thereover;

a guide roller mounted between two successive drying cylinders of said upper row, referred as first and second drying cylinders, said guide roller guiding said porous dryer fabric away from said first drying cylinder and toward said second drying cylinder, said ventilation system comprising;

a) means for establishing a positive pressure zone of air between said first drying cylinder and said guide roller outside said pocket, causing air to penetrate in said pocket through said porous dryer fabric; and b) means for (i) producing an air jet between a nip defined between said guide roller and said dryer fabric and a nip defined between said dryer fabric and said second dryer cylinder, outside said pocket and directed away from said pocket, causing a negative pressure zone and (ii) thereby extracting moisture laden air from said pocket through said dryer fabric.

2. A ventilation system as defined in claim 1, comprising:

a plenum adjacent said guide roller;

means to establish a positive air pressure within said plenum;

a plurality of first orifices on said plenum for producing a plurality of air jets directed toward a section of said dryer fabric between said first upper drying cylinder and said guide roller; and a second orifice on said plenum for producing said air jet between said guide roller and said second dryer cylinder.

3. A ventilation system as defined in claim 2, further comprising seal means between said plenum and said guide roller.

4. A ventilation system as defined in claim 2, wherein said plenum extends substantially along the entire length of said drying cylinders of said upper row.

5. A ventilation system as defined in claim 2, wherein said plenum comprises:

an inlet chamber;

an outlet chamber comprising said orifices;

diffuser means between said chambers.

6. A ventilation system as defined in claim 5, including a perforated plate between said chambers forming said diffuser means.

7. A ventilation system as defined in claim 2, comprising two generally parallel slits on said plenum extending the entire length thereof, said slits forming said first orifices.

8. A ventilation system as defined in claim 2, wherein said plenum comprises a wall facing said second drying cylinder, said wall comprising an apex, said second orifice being formed at said apex.

9. A ventilation system as defined in claim 2, wherein said first orifices are located at a level where said dryer fabric separates from said first drying cylinder.

10. An apparatus for drying a web comprising:

an upper row of rotatable drying cylinders;

a lower row of rotatable drying cylinders, said web being trained through said rows forming a pocket;

a porous dryer fabric urging said web against the drying cylinders of said upper row while said web is trained thereover;

a guide roller mounted between two successive drying cylinders of said upper row, referred as first and second drying cylinders, said guide roller guiding said porous dryer fabric away from said first drying cylinder and toward said second drying cylinder;

a pocket ventilation system, comprising:

a) means for establishing a positive pressure zone of air between said first drying cylinder and said guide roller outside said pocket, causing air to penetrate in said pocket through said porous dryer fabric; and b) means for producing an air jet between a nip defined between said guide roller and said dryer fabric and a nip defined between said second dryer cylinder and said dryer fabric, outside said pocket and directed away from said pocket, causing a negative pressure zone and constituting means for extracting moisture laden air from said pocket through said dryer fabric.

11. An apparatus as defined in claim 10, comprising:

a plenum adjacent said guide roller;

means to establish a positive air pressure within said plenum;

a plurality of first orifices on said plenum for producing a plurality of air jets directed toward a section of said dryer fabric between said first upper drying cylinder and said guide roller; and said orifice on said plenum for producing said air jet between said guide roller and said second dryer cylinder.

12. An apparatus as defined in claim 11, further comprising seal means between said plenum and said guide roller.

13. An apparatus as defined in claim 11, wherein said plenum extends substantially along the entire length of said drying cylinder of said upper row.

14. An apparatus as defined in claim 11, wherein said plenum comprises:

an inlet chamber;

an outlet chamber comprising said orifices;

diffuser means between said chambers.

15. An apparatus as defined in claim 14, including a perforated plate between said chambers forming said diffuser means.

16. An apparatus as defined in claim 11, comprising two generally parallel slits on said plenum extending the entire length thereof, said slits forming said first orifices.

17. An apparatus as defined in claim 11, wherein said plenum comprises a wall facing said second drying cylinder, said wall comprising an apex, said second orifice being formed at said apex.

18. An apparatus as defined in claim 11, wherein said first orifices are located at a level where said dryer fabric separates from said first drying cylinder.

19. A method for ventilating a pocket of a cylinder dryer which comprises:

an upper row of rotatable drying cylinders;

a lower row of rotatable drying cylinders, said web being trained through said rows forming a pocket;

a porous dryer fabric urging said web against the drying cylinders of said upper row while said web is trained thereover;

a guide roller mounted between two successive drying cylinders of said upper row, referred as first and second drying cylinders, said guide roller guiding said porous dryer fabric away from said first drying cylinder and toward said second drying cylinder, said method comprising the steps of:

a) establishing a positive pressure zone of air between said first drying cylinder and said guide roller outside said pocket, for causing air to penetrate in said pocket through said porous dryer fabric; and b) producing an air jet between a nip defined between said guide roller and said dryer fabric and a nip defined between said second dryer cylinder and said dryer fabric, outside said pocket and directed away from said pocket, causing a negative pressure zone to extract moisture laden air from said pocket through said dryer fabric.

* * * * *